US007032974B1

(12) United States Patent
Berger

(10) Patent No.: US 7,032,974 B1
(45) Date of Patent: Apr. 25, 2006

(54) HEADREST ASSEMBLY

(76) Inventor: Karla Klumpp Berger, 453 Hidden Ridge Rd., Charlottesville, VA (US) 22902

( * ) Notice: Subject to any disclaimer, the term of this patent is extended or adjusted under 35 U.S.C. 154(b) by 0 days.

(21) Appl. No.: 10/824,533

(22) Filed: Apr. 14, 2004

Related U.S. Application Data

(60) Provisional application No. 60/492,943, filed on Aug. 6, 2003.

(51) Int. Cl.
*A47C 1/10* (2006.01)

(52) U.S. Cl. ..... 297/398

(58) Field of Classification Search ..... 297/406–407, 297/394, 397–401, 410, DIG. 4, 452.4, 391, 297/409, 404, 402, 184.1, 184.11, 184.15, 297/230.1, 216.12, DIG. 1; 280/288.4, 250.1; 248/229.16, 229.26, 230.7, 231.81, 118, 118.1; 403/289
See application file for complete search history.

(56) References Cited

U.S. PATENT DOCUMENTS

| | | | | | |
|---|---|---|---|---|---|
| 290,644 | A | | 12/1883 | Koenig | |
| 522,192 | A | * | 7/1894 | Browne | 297/407 |
| 3,476,404 | A | * | 11/1969 | Rachman | 280/30 |
| 3,674,310 | A | | 7/1972 | Montagano | |
| 3,730,589 | A | * | 5/1973 | Lane | 297/391 |
| 3,759,572 | A | * | 9/1973 | Koepke | 297/452.4 |
| 4,030,781 | A | * | 6/1977 | Howard | 297/397 |
| 4,082,348 | A | | 4/1978 | Haury | |
| 4,375,901 | A | * | 3/1983 | MacDonald | 297/377 |
| 4,470,630 | A | * | 9/1984 | Shields | |
| 4,498,704 | A | | 2/1985 | Hildreth | |
| 4,948,197 | A | * | 8/1990 | Sansing | 297/188.14 |
| 4,989,836 | A | | 2/1991 | Hudson | |
| 5,022,420 | A | * | 6/1991 | Brim | 135/88.01 |
| 5,074,574 | A | | 12/1991 | Carwin | |
| 5,308,028 | A | | 5/1994 | Kornberg | |
| 5,320,412 | A | | 6/1994 | Eakins | |
| 5,586,810 | A | * | 12/1996 | Liu | 297/406 |
| 5,690,387 | A | | 11/1997 | Sarti | |
| 5,791,614 | A | * | 8/1998 | Sims | 248/230.7 |
| 5,967,601 | A | * | 10/1999 | Gillins | 297/184.15 |
| 5,967,613 | A | | 10/1999 | McKeever | |
| 6,015,189 | A | | 1/2000 | Broadhead | |
| 6,099,021 | A | * | 8/2000 | Benoit | 280/647 |
| 6,102,475 | A | * | 8/2000 | Hamann | 297/172 |
| 6,193,252 | B1 | * | 2/2001 | Lin | 280/204 |
| 6,866,288 | B1 | * | 3/2005 | Martin | 280/647 |
| 2004/0104614 | A1 | * | 6/2004 | Higley et al. | 297/452.4 |

FOREIGN PATENT DOCUMENTS

| | | | |
|---|---|---|---|
| JP | 2001327541 | * | 11/2001 |

* cited by examiner

*Primary Examiner*—Milton Nelson, Jr.
(74) *Attorney, Agent, or Firm*—Michael Haynes PLC

(57) ABSTRACT

Certain exemplary embodiments provide an apparatus comprising: a headrest assembly adapted to non-destructively attach to a pair of uprights of a wheelchair. Certain exemplary embodiments provide a method comprising: non-destructively removably attaching a headrest assembly to a pair of uprights supporting a seat back; and adjusting the headrest assembly.

10 Claims, 7 Drawing Sheets

HEADREST ASSEMBLY

CROSS-REFERENCE TO RELATED APPLICATIONS

This application claims priority to, and incorporates by reference in its entirety, now abandoned provisional U.S. Patent Application Ser. No. 60/492,943, filed 6 Aug. 2003.

BRIEF DESCRIPTION OF THE DRAWINGS

A wide variety of potential embodiments will be more readily understood through the following detailed description, with reference to the accompanying drawings in which.

Figure 1:
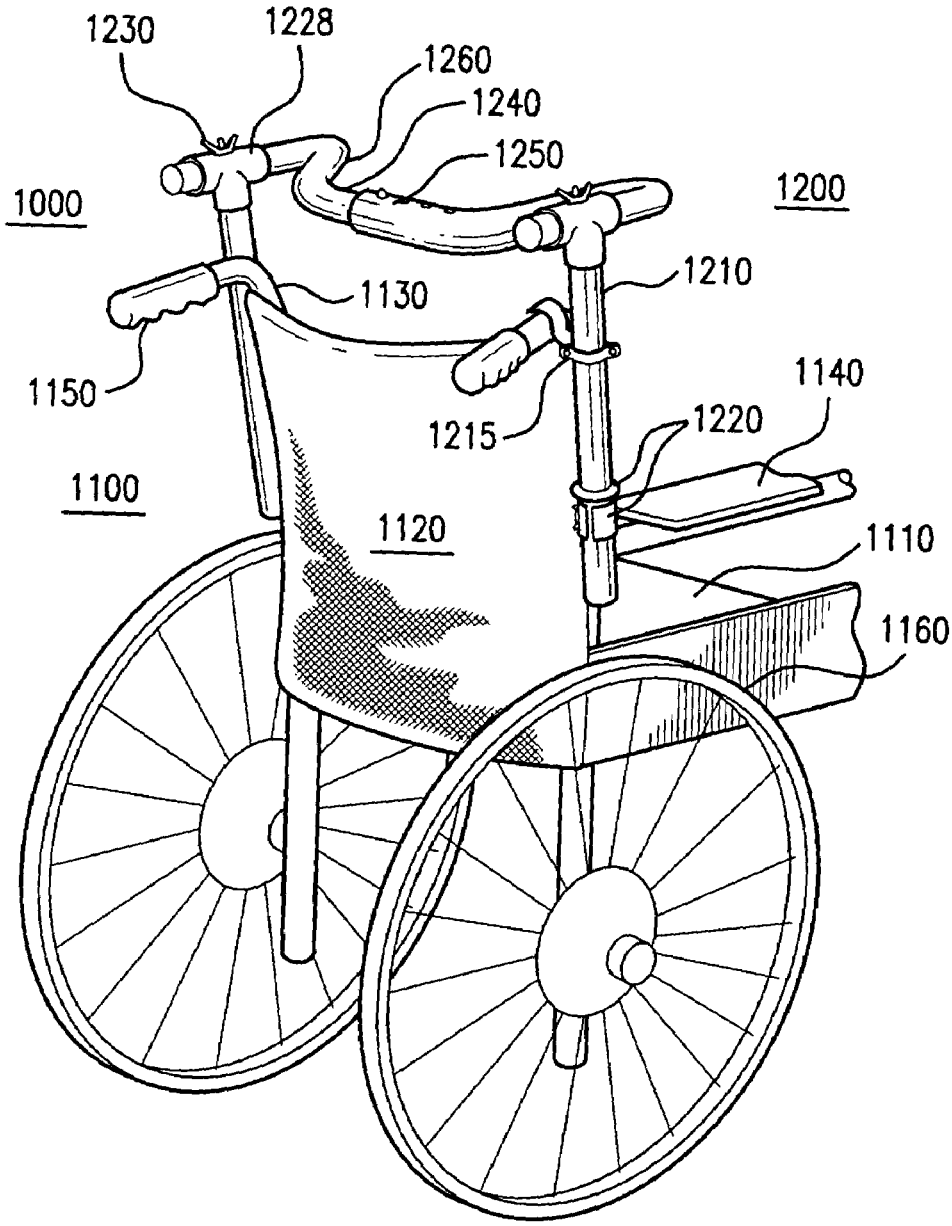
FIG. 1 is a rear perspective view of an exemplary wheelchair and a exemplary headrest assembly attached thereto.

DEFINITIONS wheelchair—a chair mounted on wheels for the use of a sick or disabled person.

upright—a substantially vertical support for a seatback of a wheelchair.

seatback—an occupant-supporting back of a chair or other type of seating.

headrest—a support for the head and/or neck, typically located on or near the back of a chair.

non-destructively—of, relating to, or being a process that does not result in damage to the subject material and/or product.

snapably—to be able to open, close, and/or fit together with a click.

removably—to be able to move from a place or position occupied.

attach—to fasten, secure, couple, and/or join.

detach—the opposite of attach.

rigid—substantially inflexible.

horizontal—parallel to and/or in the plane of the horizon.

vertical—substantially perpendicular to horizontal.

member—a structural unit.

spanning—extending across in space.

height adjuster—a mechanism for adjusting a position along a direction that is perpendicular to the ground.

width adjuster—a mechanism for adjusting a position along a direction that is substantially parallel to an axis of rotation of the wheels of the wheelchair.

depth adjuster—a mechanism for adjusting a position along a direction that is substantially parallel to at least an instantaneous direction of travel of the wheelchair.

incline adjuster—a mechanism for adjusting a position along at least a portion of an arc that spans from substantially vertical to substantially horizontal in a plane that is parallel to at least an instantaneous direction of travel of the wheelchair.

head support—a mechanism for limiting motion of an occupants head and/or neck in a predetermined direction.

lateral head support—a mechanism for limiting motion of an occupants head and/or neck in a direction that is substantially parallel to an axis of rotation of the wheels of a wheelchair.

head pad—a cushion for a head and/or neck support.

DETAILED DESCRIPTION

Certain exemplary embodiments provide a headrest assembly for people seated in chairs and/or wheelchairs. Certain exemplary headrest assemblies can help provide support for the head, reduce fatigue of the neck and/or shoulder muscles, and/or attenuate travel vibrations and/or absorb shocks, etc.

Certain exemplary headrest assemblies can snapably and/or releasably attach, or permanently attach, to any known model of wheelchair, in certain cases quickly, easily, and/or without requiring modification of the wheelchair. Certain exemplary headrest assemblies can be adjustable to fit each chair occupant, do not interfere with the folding of the wheelchair, and/or include a machine-washable head pad.

Certain exemplary embodiments provide a wheelchair headrest assembly that can be adjustable in height, width, and/or depth (forward/back). In certain exemplary embodiments, the headrest assembly can attach firmly to any known wheelchair, using any of a number of modes of attachment, potentially including modes of attachment that do not require alteration of the chair. Certain exemplary embodiments can provide comfortable and/or sufficient lateral head support, which can facilitate napping while seated. Certain exemplary embodiments of the headrest assembly can be non-destructively attached to the wheelchair and/or non-destructively detached from the wheelchair. Certain exemplary embodiments can be easily removed from the wheelchair and/or can allow the chair to be folded for transport and/or storage.

Figure 2:
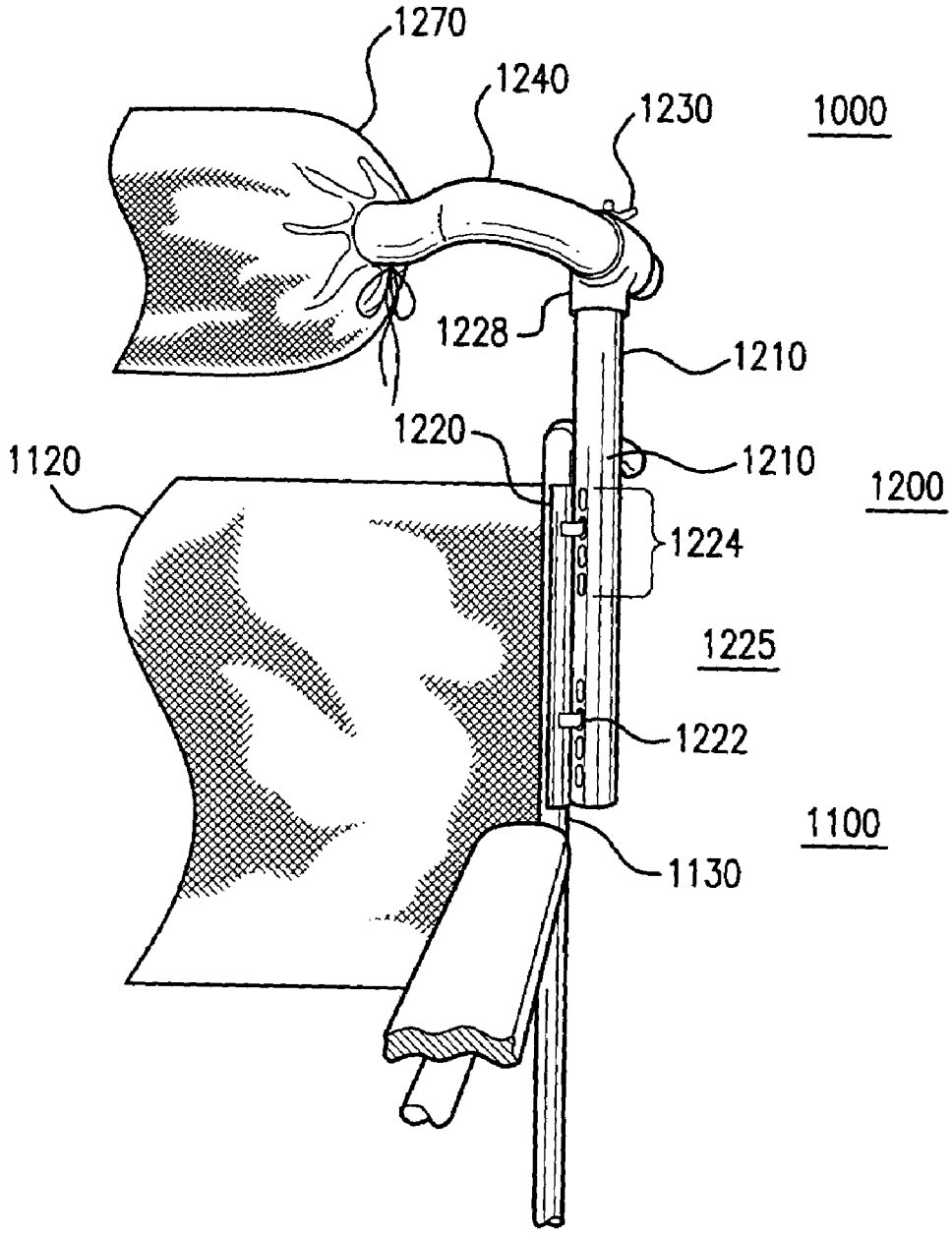
FIG. 2 is a front perspective view of at least a portion of an exemplary headrest assembly attached to an exemplary wheelchair upright.

FIG. 1 is a rear perspective view, and FIG. 2 is a partial front perspective view, of an exemplary system 1000 that can comprise a wheelchair 1100 and a headrest assembly 1200 non-destructively attached thereto. Wheelchair 1100 can comprise a seat 1110, a seatback 1120, uprights 1130, armrests 1140, handles 1150, and/or wheels 1160. Headrest assembly 1200 can comprise vertical members 1210, stabilizers 1215, upright attachments 1220, vertical adjusters 1225, couplers 1228, depth adjusters 1230, horizontal members 1240, width adjuster 1250, lateral head supports 1260, and/or head pad 1270.

Headrest assembly 1200 can be formed from components constructed from aluminum, stainless steel, PVC, etc. For example, certain components, such as vertical members 1210 and/or horizontal members 1240 can be constructed from telescoping aluminum tubes such as that used for walkers.

Vertical member 1210, which can be formed from tubular material, can be removably, snapably, clampably, and/or non-destructively attached to a wheelchair upright 1130 via one or more upright attachments 1220. For example, upright attachment 1220 can be constructed from a tube (e.g., an aluminum, stainless steel, and/or PVC, etc.) that has had a full-length longitudinal strip and/or portion removed therefrom, so that the tube can be sprung open and snapably attached to upright 1130, which itself can be a tubular member. As another example, upright attachment 1220 can be a clamp, such as a double-conduit clamp, and/or a clothespin-style clamp.

A stabilizer 1215 can coupled a vertical member 1210 to a nearby wheelchair handle 1150. The vertical position of vertical member 1210 with respect to upright 1130 can be adjusted and/or maintained via one or more upright attachments 1220 and/or one or more vertical adjusters 1225, which can comprise one or more vertical adjuster pins or hooks 1222 and one or more vertical adjuster hook receivers 1224. The vertical members 1210 can be coupled to the horizontal members 1240 via couplers 1228.

Horizontal members 1240 can cooperate to form a substantially rigid, continuous cross member coupling vertical members 1210 and/or spanning a width defined by uprights 1130, can be formed from, for example, a tubular material, and/or can be shaped in a partial "S" configuration. A lateral head support 1260 can be defined by, coupled to, and/or integral to each horizontal member 1240. Each horizontal member 1240 can be coupled and/or secured to its respective vertical member 1210 by virtue of a coupler 1228, which can be formed as, for example, an open-ended T-fitting. Each coupler 1228 can comprise a depth adjuster 1230, which can allow for adjustment and/or maintenance of a depth of horizontal members 1240, which can be slidable through coupler 1228.

Each depth adjuster 1230 can comprise a releasable securement, such as a removable pin, spring-loaded pin, releasable ring, threaded locking screw, bolt-and-nut arrangement, spring-loaded ball detent mechanism that interacts with complementary receiving holes in either coupler 1228 or horizontal member 1240, etc. The releasable securement can be released and/or loosened to facilitate adjustment of a depth of its respective horizontal member 1240, de-coupling of its respective horizontal member 1240 from corresponding vertical member 1210, and/or at least partial disassembly of headrest assembly 1200.

A width of horizontal members 1240 can be adjusted and/or maintained via width adjuster 1250, such as to allow headrest assembly 1200 to fit wheelchairs of different widths. Thus, headrest assembly 1200 can fit wheelchairs having uprights that define different spacings, widths, and/or spans therebetween.

Width adjuster 1250 can be disassembled to allow assembly, removal, and/or replacement of head pad 1270, which can resemble an elongated annulus, and/or can comprise a foam material, such as expanded polyurethane, expanded polyethylene, etc., surrounded by a washable fabric, such as cotton, polyester, etc., which can be secured around the foam via a drawstring, zipper, hook-and-loop fastener, etc. Head pad 1270 can contact, cushion, support, and/or restrict motion of the chair occupant's head and/or neck.

The configuration of horizontal members 1240 can form lateral head supports 1260, which can substantially prevent an occupant's head from falling far to one side, thereby potentially preventing neck aches from sleeping in a tilted position, tipping of the wheelchair, and/or injury to the occupant. Moreover, lateral head supports 1260 can facilitate napping, potentially even reasonably comfortable napping, by the occupant while seated in a substantially upright position.

Figure 3:
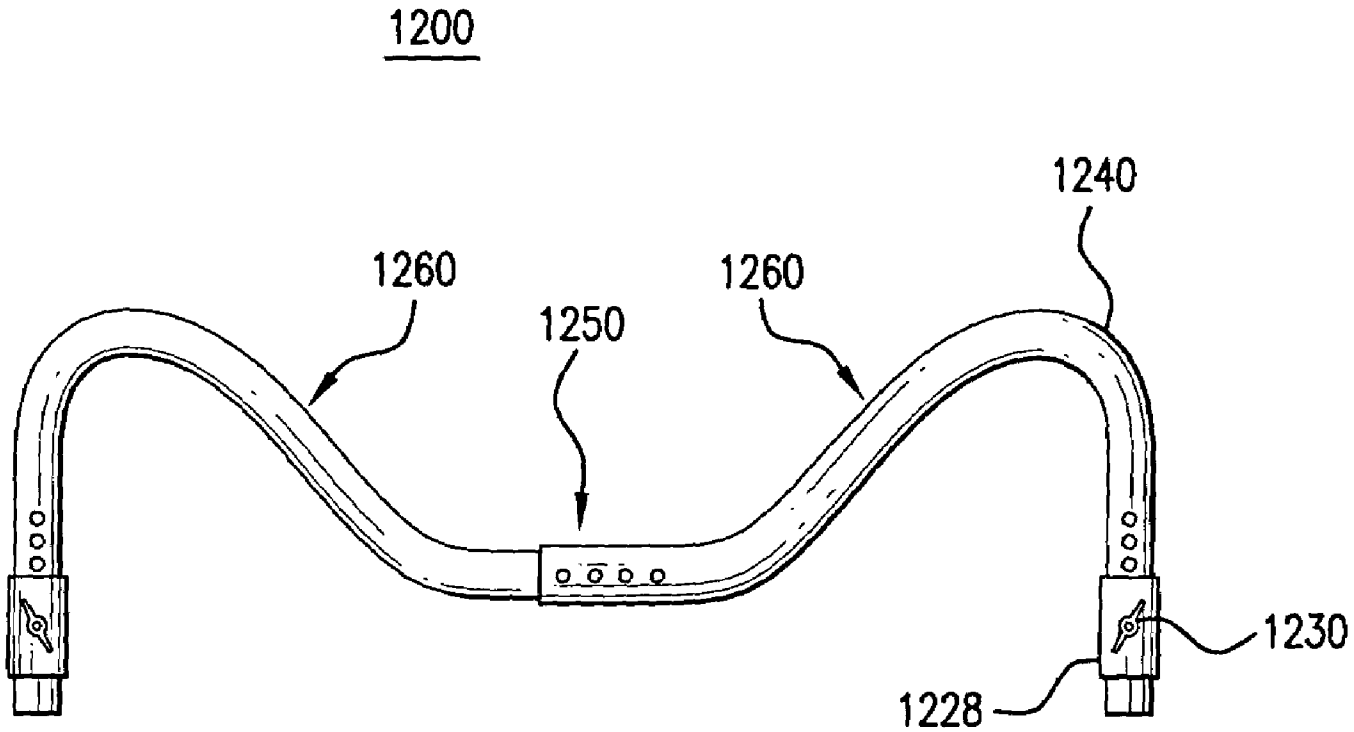
FIG. 3 is a top view of a rear of at least a portion of an exemplary headrest assembly.

FIG. 3 is a top view of a rear of at least a portion of an exemplary headrest assembly 1200. A width adjuster 1250, which can be embodied as a threaded union, a spring-loaded ball detent mechanism with complementary receiving holes in telescoping tubular horizontal members 1240, etc., can couple together a pair of horizontal members 1240 to form a single horizontal cross-member. Each horizontal member 1240 can be attached to a vertical member via a coupler 1228.

Figure 4:
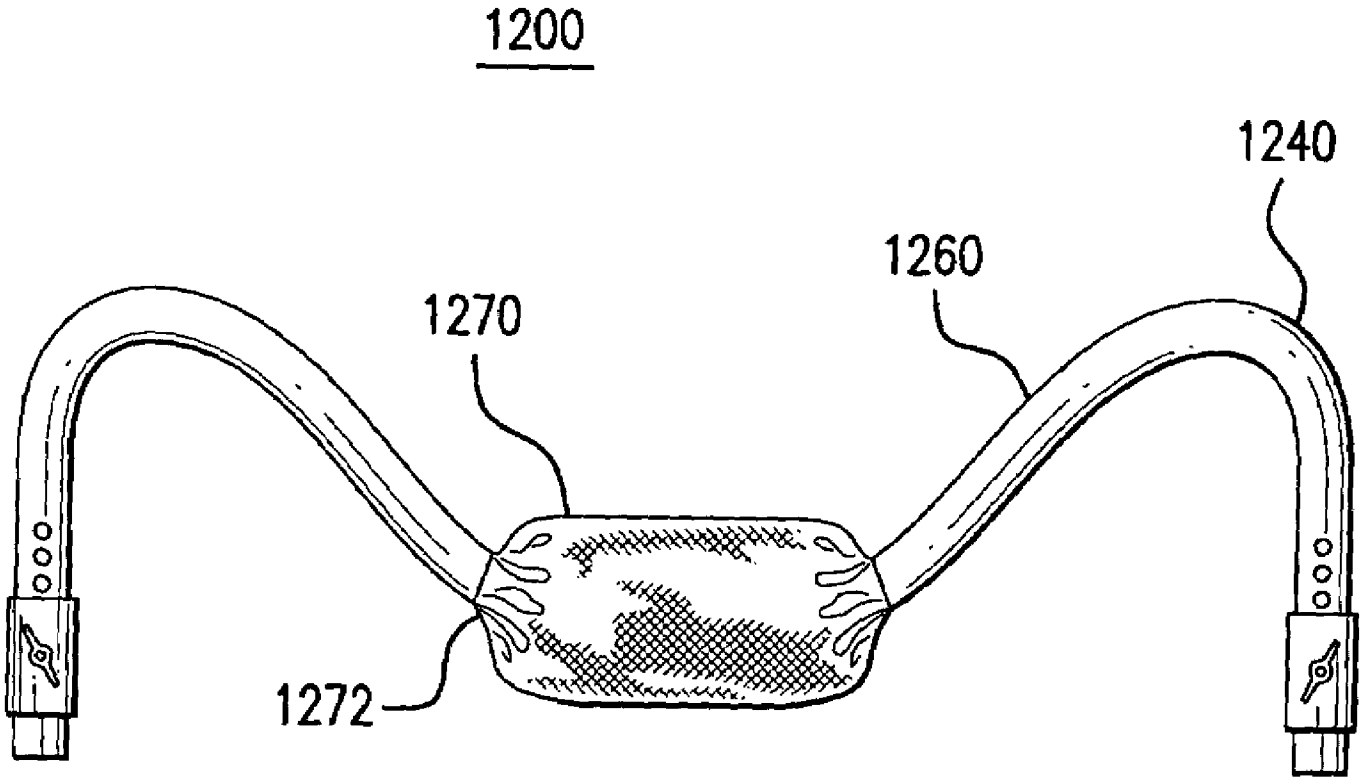
FIG. 4 is a top view of a rear of at least a portion of an exemplary headrest assembly.

FIG. 4 is a top view of a rear of at least a portion of an exemplary headrest assembly 1200, showing head pad 1270 attached to horizontal members 1240. Head pad 1270 can comprise a securement 1272, such as for example, a drawstring, zipper, hook-and-loop fastener mechanism, etc., which can be used to secure a position of head pad 1270 on horizontal member 1240. Head stops 1260 can resist and/or partially resist unwanted movement of head pad 1270.

Figure 5:
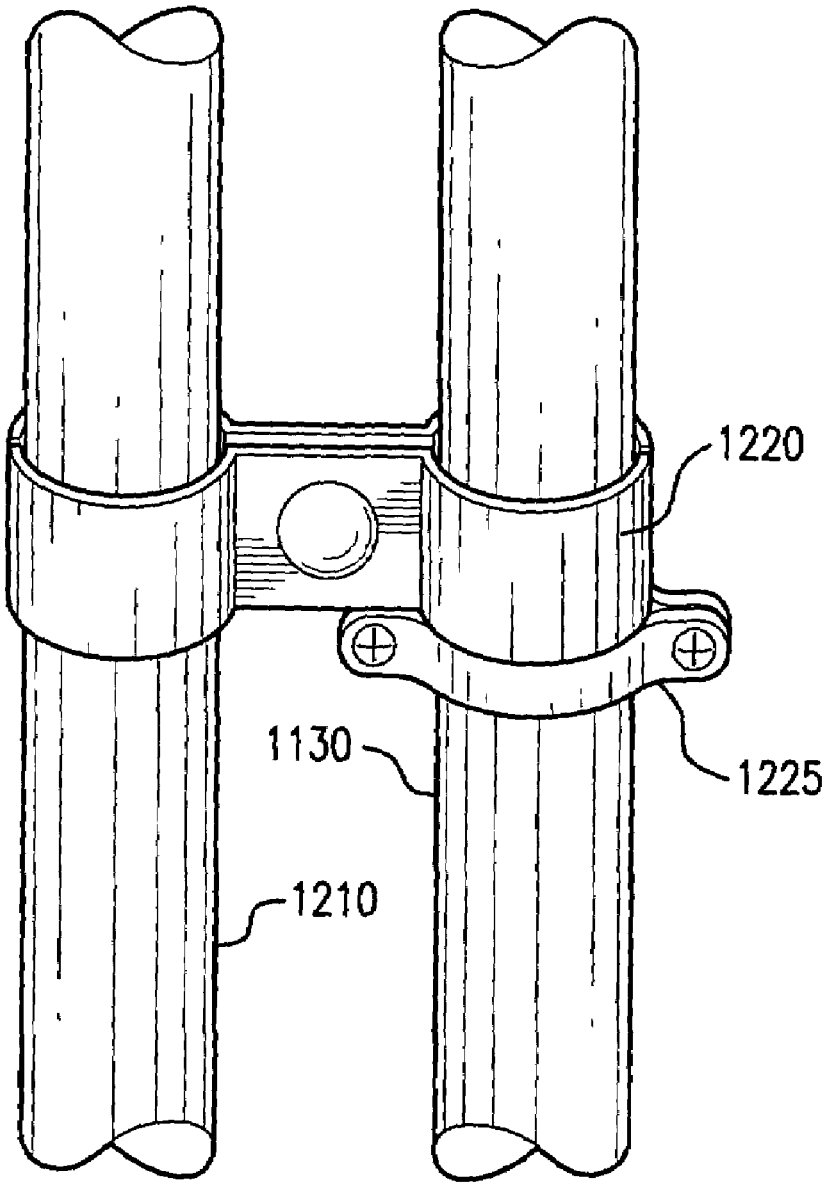
FIG. 5 is a perspective view of an exemplary attachment mechanism.

FIG. 5 is a perspective view of an exemplary upright attachment 1220 coupling a vertical member 1210 to an upright 1130. Vertical adjuster 1225 can allow a vertical position of vertical member 1210 with respect to upright 1130 to be fixed at a predetermined location.

Figure 6:
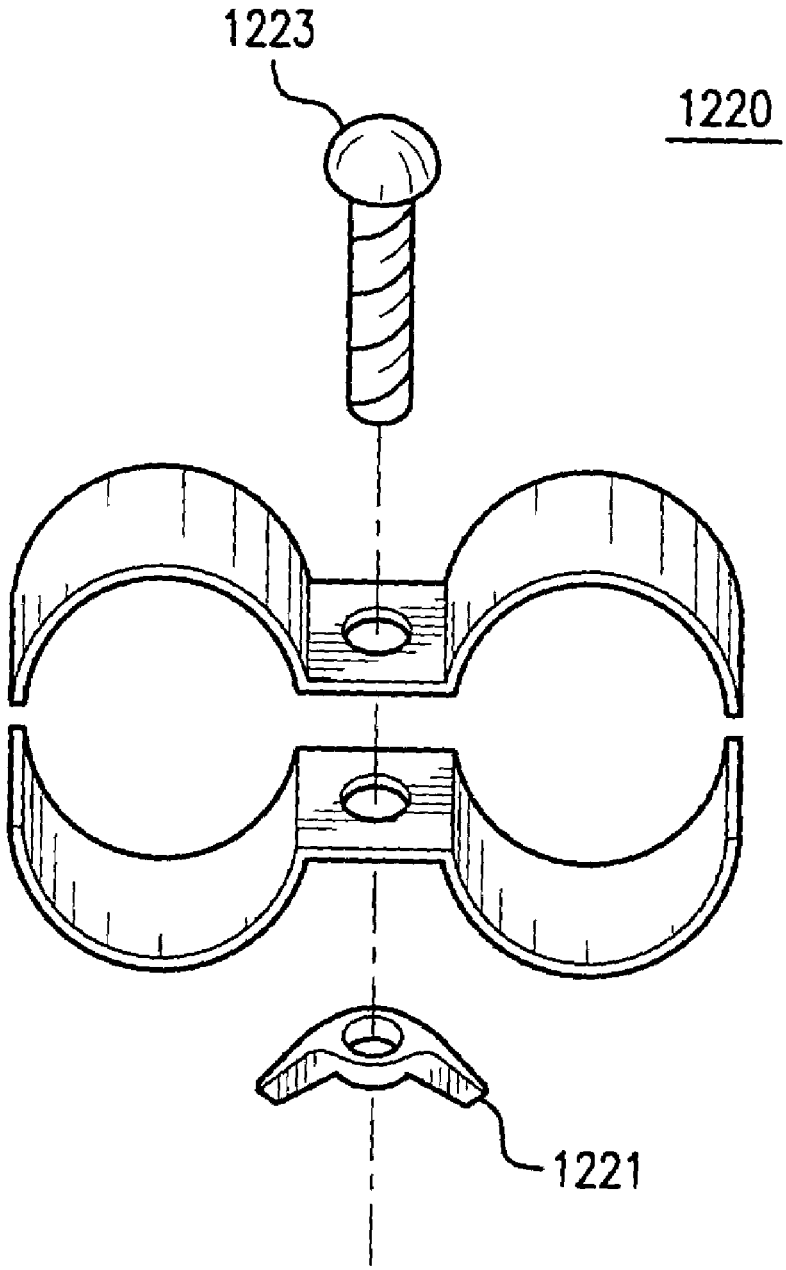
FIG. 6 is a perspective view of an exemplary attachment mechanism.

FIG. 6 is an end perspective view of an exemplary upright attachment 1220, illustrating that by loosening a wingnut 1221 attached to a carriage bolt 1223, upright attachment can be loosened, thereby allowing a vertical member to be clampably attached to an upright, adjusted in position on an upright, and/or nondestructively removed from the upright. Mechanism incorporating a spring and/or bias are also possible.

Figure 7:
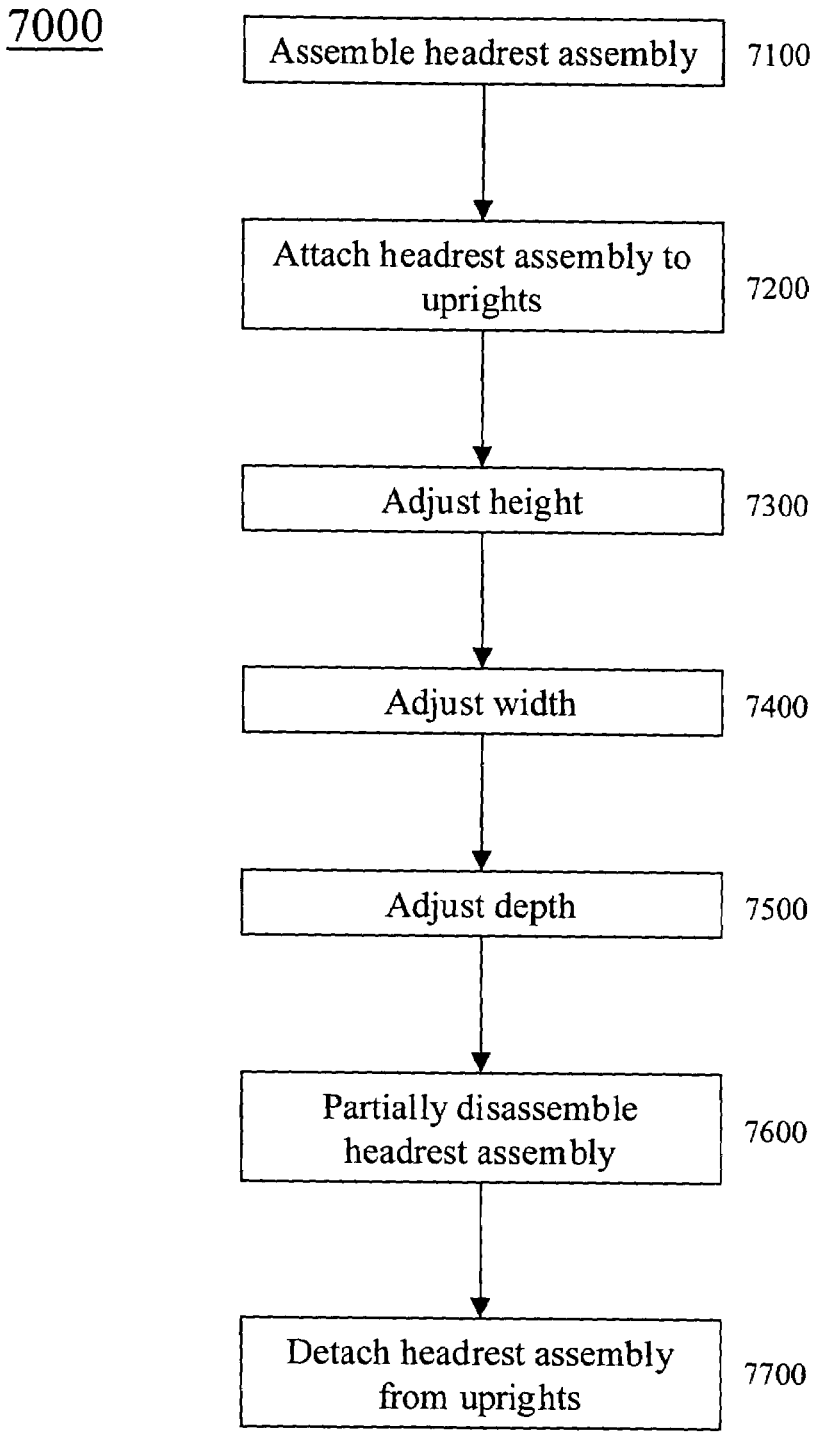
FIG. 7 is a flowchart of an exemplary method.

FIG. 7 is a flowchart of an exemplary method 7000. At activity 7100, at least a portion of a headrest assembly can be assembled. In certain exemplary embodiments, the headrest assembly can be assembled without the use of tools, and/or with only the use of, for example, a Phillips-head screwdriver. At activity 7200, a vertical member of a headrest assembly can be non-destructively attached an upright of a wheelchair. At activity 7300, a height of at least a portion of the headrest assembly can be adjusted. At activity 7400, a width of at least a portion of the headrest assembly can be adjusted. At activity 7500, a depth of at least a portion of the headrest assembly can be adjusted, either before or after the occupant has been seated in the wheelchair, to a desired position, such as a position that optimizes comfort for the occupant. Note that by adjusting the depth and/or height of the headrest assembly, the inclination of the occupant and/or headrest assembly can be adjusted. Thus, the depth adjuster and/or height adjuster can function as an incline adjuster.

At activity 7600, the headrest assembly can be nondestructively and partially disassembled to allow form two opposing lateral portions, each of which can be rotated with respect to their upright, to at least partially disable the ability of headrest assembly to support the head of the occupant of the wheelchair. This can allow the occupant of the wheelchair, while remaining seated in the wheelchair, to lean backwards, such as for hairwashing, dental work, etc. Partial disassembly of the headrest assembly can allow the wheelchair to be folded for transport and/or storage.

At activity 7700, the headrest assembly can be nondestructively detached from the pair of uprights, thereby potentially leaving the wheelchair the condition it was in prior to attachment of the headrest assembly thereto.

Each of following United States patents is incorporated by reference herein in its entirety: U.S. Pat. No. 290,644 (Koenig); U.S. Pat. No. 3,674,310 (Montagano); U.S. Pat. No. 4,082,348 (Haury); U.S. Pat. No. 4,498,704 (Hildreth); U.S. Pat. No. 4,989,836 (Hudson); U.S. Pat. No. 5,074,574 (Carwin); U.S. Pat. No. 5,308,028 (Kornberg); U.S. Pat. No. 5,320,412 (Eakins); U.S. Pat. No. 5,690,387 (Sarti); U.S. Pat. No. 5,967,613 (McKeever); U.S. Pat. No. 6,015,189 (Broadhead).

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render any claim seeking priority hereto invalid, then any such conflicting information in such incorporated by reference material is specifically not incorporated by reference herein.

What is claimed is:

1. An apparatus comprising:

a headrest assembly adapted to non-destructively snapably attach to a pair of uprights of a wheelchair, said headrest assembly comprising a substantially rigid horizontal member adapted to substantially span a width defined by the pair of uprights and to substantially span above handles of the wheelchair, said horizontal member comprising a substantially horizontally extending and substantially rigid lateral head support that is integral to said horizontal member, said headrest assembly comprising a headrest width adjuster surrounded by a head pad.

2. The apparatus of claim 1, wherein said headrest assembly is adapted to non-destructively detach from the pair of uprights.

3. The apparatus of claim 1, wherein said lateral head support is shaped in a partial "S" configuration.

4. The apparatus of claim 1, wherein said lateral head support comprises a pair of opposing head supports.

5. The apparatus of claim 1, wherein said headrest assembly comprises a headrest depth adjuster.

6. The apparatus of claim 1, wherein said head pad is removable.

7. The apparatus of claim 1, wherein said headrest assembly comprises a headrest height adjuster.

8. The apparatus of claim 1, wherein said head pad is washable.

9. The apparatus of claim 1, wherein said horizontal member comprises said headrest width adjuster.

10. The apparatus of claim 1, wherein said horizontal member comprises said headrest width adjuster and said head pad.

* * * * *